US005623977A

United States Patent [19]

Sparks

[11] Patent Number: 5,623,977

[45] Date of Patent: Apr. 29, 1997

[54] CHIPPER BLADE FOR CHIPPER HAVING RADIUSED CUTTING EDGE

[75] Inventor: James R. Sparks, Yamhill, Oreg.

[73] Assignee: U.S. Natural Resources, Inc., Vancouver, Wash.

[21] Appl. No.: 596,385

[22] Filed: Dec. 11, 1995

[51] Int. Cl.[6] ..... B27G 13/04

[52] U.S. Cl. ..... 144/220; 144/162.1; 144/241; 407/46; 407/101; 407/115; 407/41

[58] Field of Search ..... 407/1, 2, 6, 41–46, 407/113–117, 37, 40, 101; 144/162.1, 176, 218, 220, 241, 229; 241/91, 92, 189.1, 292.1, 278, 298

[56] References Cited

U.S. PATENT DOCUMENTS 5,501,256 3/1996 Dyer et al. ..... 144/220

5,505,239 4/1996 Sparks ..... 144/241

5,511,597 4/1996 Shantie, et al. ..... 144/241

*Primary Examiner*—W. Donald Bray

*Attorney, Agent, or Firm*—Robert L. Harrington

[57] ABSTRACT

A finishing blade having a radiused cutting edge for a chipper to produce a smooth finish on a surface of a log. The blades are mounted on the chipper such that a cut produced by one blade will be overlapped by a succeeding blade. The cutting edge of the finishing blade is radius ground to a slight curvature. The curvature of the cutting edge assures that the plane of cut produced by a first blade will be intersected by a succeeding blade.

3 Claims, 2 Drawing Sheets

CHIPPER BLADE FOR CHIPPER HAVING RADIUSED CUTTING EDGE

FIELD OF THE INVENTION

This invention relates to chippers used to open the face of a log and more particularly to a chipper blade segment provided with an improved cutting edge for finishing the surface of the opened face.

BACKGROUND OF THE INVENTION

A certain portion of opposed curved sides of a log to be cut into lumber pieces is unusable for lumber. That portion is removed from the log (referred to as opening the face of the log) and cut into chips for pulp. A process for removing and chipping the unusable portions of a log involves first cutting the portions from the log, e.g., using a band saw or circular saw, and then sending the cut off portions through a chipper for reducing the portions to chips. Obviously if the log portion can be chipped from the log directly, one step or operation of the process is eliminated which is highly desirable.

Chippers have been developed for accomplishing open faced chipping, i.e., removing and chipping the unusable portions in one operation. A log is directed through a chipping station and a chipper on each side of the log is manipulated to chip the "unusable" portions and in the process produces opposed flat parallel faces spaced apart at a desired dimension. The logs (now referred to as cants) are then cut into flitches with each flitch having parallel side surfaces of a specific width that are then trimmed into boards.

A criteria of the chippers used for opening the faces of the log is that they need to produce an acceptably smooth surface as that surface will ultimately be one side of a board. If the surface is gouged or feathered, the log or cant will have to go through a secondary finishing operation which defeats the objective of accomplishing the opening of the log and chipping the non-usable portions in one operation.

To achieve the smooth surface, a chipper used for open faced chipping is provided with multiple sets of a pair of cooperating blade edges referred to as a hogging blade edge and a finishing blade edge. The hogging blade edge is angled into the log and determines the depth of cut of a chip (the depth terminating precisely at the face) and the finishing blade cuts off the chip at the desired open face, the finishing cut being co-planar with the face. Each blade set follows one after the other in an overlapping manner and as long as all of the finishing blade edges are cutting in exactly the same plane, a smooth flat face is produced.

The exact setting of multiple blade edges in a common plane is not feasible and an acceptable tolerance for the setting of the finishing blades is about plus or minus 0.002 inches from the established plane of the face. A variation of plus or minus 0.002 inches is acceptable for lumber production as long as the face is perceptively smooth, i.e., it contains no unsightly ridges or feathered wood fibers.

In the open faced chippers currently in use, the finishing blade edge is a flat edge oriented in the plane of the face or parallel to the plane of the face plus or minus 0.002 inches. One blade follows the next blade and because there is some offset, e.g., by several thousandths of an inch, the cuts are not in alignment and accordingly the cuts do not intersect each other. The wood fiber in the gap between the offset cuts is ripped off rather than being cut off. The gap itself produces a ridge or groove and the tearing of the fibers will produce the undesired feathering of the open face, particularly as the cutting edge corners become dulled.

Accordingly, an objective of the present invention is to reduce or eliminate the undesired grooves and feathering produced during open faced chipping.

BRIEF DESCRIPTION OF THE PRESENT INVENTION

The preferred embodiment of the present invention provides the finishing blade edge with a slight radius. Consider a finishing blade designed to cut a one inch chip. The cutting edge is typically 1⅝ inch in length and overlaps with a preceding and succeeding cutting edge by ⅝ of an inch. If placement of the blade is maintained within plus or minus 0.002 inches, the cutting edges of succeeding blades will always be intersecting if the valley to peak distance of the curve along the 1⅝ inch blade is 0.006 inches.

Maintaining the above relationship insures an open face surface that has no grooves or feathering. The intersecting curves produced by the curved blade edges are at such obtuse angles that the intersection is not detectable and to the extent that the trailing edge corner of the blade does cut into the wood and may dull, the overlapping end of the succeeding blade cuts away any feathering as a result of that dulling.

Whereas the 0.006 inch valley to peak distance is established for a worst case situation, a somewhat less distance will be found acceptable. All of the above will be made more clear upon reference to the specific embodiment disclosed and the accompanying drawings.

DESCRIPTION OF THE PREFERRED EMBODIMENT

Figure 1A:
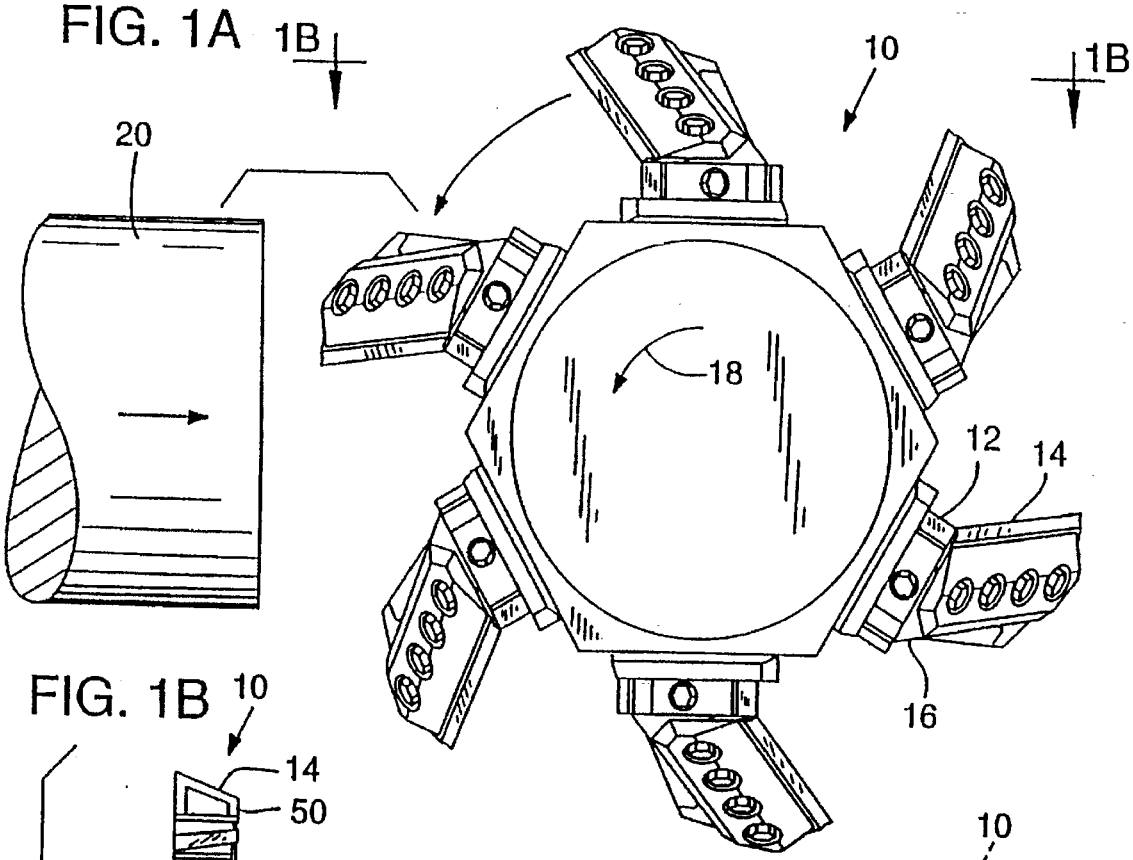
FIGS. 1A and 1B illustrate a chipper used to open a face of a log.
Figure 1B:
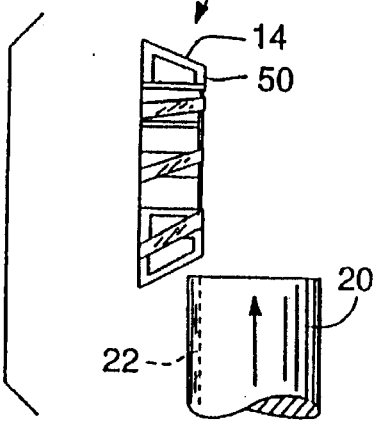

As previously mentioned, chippers have been developed to accomplish open face chipping, that is, removing and chipping the unusable portions of the log in one operation. Referring to FIGS. 1A and 1B, a chipper 10 of a chipping machine has multiple blade sets 12 and 14 removably mounted to a holder 16. The cutting blade 12 is referred to as a finishing blade and the cutting blade 14 is referred to as a hogging blade. The chipper 10 is rotatable as indicated by arrow 18 and as a log 20 is fed into the chipper 10, the chipper 10 will remove material from the log 20 and will produce a surface as indicated by the dash line 22 in FIG. 1B and as indicated by 22 in FIG. 2.

The finishing blades (cutters) 12 of the past have a straight cutting edge. The surface 22 of the log 20 that is produced by the finishing blades 12 of the chipper 10 will only be smooth when all of the finishing blades 12 are mounted on the holder 16 such that the cutting edges of all the finishing blades 12 will travel in the same plane. It has been found that it is not feasible or attainable to mount the finishing blades 12 on the holder 16 such that each blade 12 will travel along the same plane as the chipper 10 is rotated. Since the finishing blades 12 in all probability will not be exactly aligned to travel along the same plane of travel, the surface 22 resulting from the chipping action may be visually lined due to the edges formed between cuts and not acceptable as a side of a board.

Figure 2:
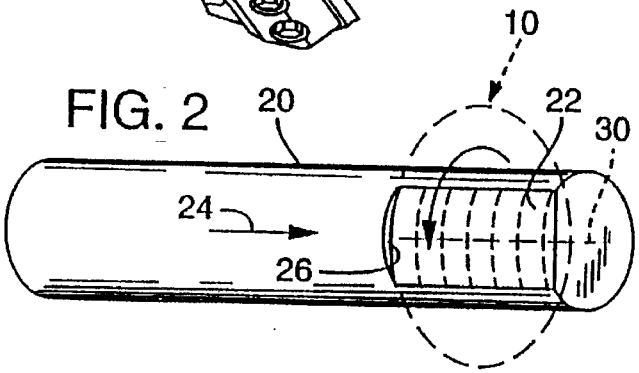
FIG. 2 is a view illustrating a log being chipped by the chipper of FIG. 1.
Figure 3:
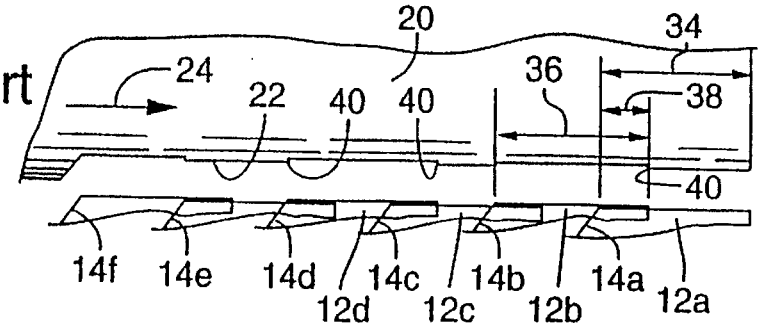
FIG. 3 Prior Art
FIG. 3 illustrates the type of finishing cut experienced by the chippers of the prior art.

Refer now to FIGS. 2 and 3 of the drawings. FIG. 2 illustrates a log 20 being fed into the chipper 10 as indicated by the arrow 24. As the log 20 is fed into the chipper 10, material 26 will be removed from the log 20 by the blades 12, 14 and in the process blades 12 will generate the face 22 on the log 20. The finishing blades 12, which in all probability are not aligned to travel along the same plane, will thus generate uneven surface contours on the face 22 as schematically illustrated in FIG. 3.

The surface of the face 22 is shown in sectional view in FIG. 3 as indicated by section lines 3—3 in FIG. 2. Also schematically shown in FIG. 3 are the progression of the finishing blades 12*a*–12*f* (the adjoining hogging blades 14*a*–14*f* are shown in part), that produce the surface 22 as the chipper 10 is rotated during feeding of the log 20. For illustrative purposes the finishing blades are shown spaced away from the surface 22. The finishing blades are arranged such that a succeeding finishing blade 12 will overlap a portion of the preceding cut made by the previous blade 12.

As the log 20 is fed into the chipper 10, blade 12*a* would have produced a cut on the face 22 as indicated by the arrow 34. Blade 12*b* would make the next finishing cut along the log 20 and this cut is indicated by arrow 36. As shown, the blade 12*b* would overlap the cut made by the blade 12*a* with the overlapping distance being indicated by the arrow 38.

As illustrated in FIG. 3, the blades 12*a* and 12*b* are slightly out of alignment (12*a* is slightly spaced further away from the log) and thus their cutting edges do not travel along the same plane. While blade 12*a* would produce the cut indicated by the length of arrow 34, the succeeding blade 12*b* produces a cut as indicated by the length of arrow 36 and thus the cut produced by blade 12*a* is overlapped by the blade 12*b* as indicated by the distance arrow 38. The cuts produced by the blades 12*a* and 12*b* when out of alignment will not lie on the same plane and further the cuts produced will not intersect. Since the cutting edges of the blades 12*a* and 12*b* are out of alignment, the cuts produced will generate an uneven surface on the face 22. Similarly the cut produced by blade 12*c* will overlap the cut produced by blade 12*b*, the cut produced by blade 12*d* will overlap the cut produced by blade 12*c* and so forth as the chipper 10 is rotated to remove the unusable portion 26 from the log 20. As shown, the surface of the face 22 will not be a smooth surface but will have jagged corners or edges as indicated by 40.

Figure 4:
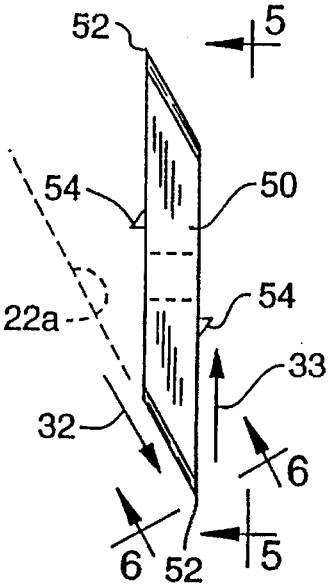
FIG. 4 illustrates a finishing blade of the present invention.
Figure 5:
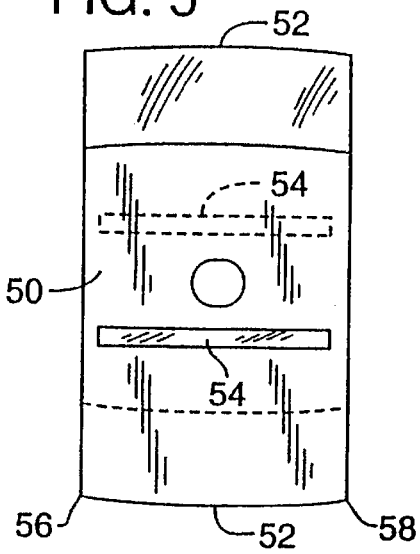
FIG. 5 illustrates the finishing blade of FIG. 4 as viewed on view lines 5—5.
Figure 6:
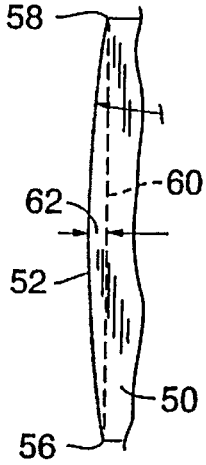
FIG. 6 is a view of the finishing blade of FIG. 4 as viewed on view lines 6—6.

Refer now to FIGS. 4, 5 and 6 of the drawings which illustrates a chipper blade having a radiused cutting edge hereafter referred to as a finishing blade (cutter) 50. The finishing blade 50 is arranged for reversible mounting in the chipper holder 16 and has cutting edges 52 at each of its ends. The finishing blade 50 also includes chip breakers 54 that extend from the surface of the finishing blade 50 and are provided to facilitate breaking chips that are removed from the log 20 during the chipping operation. To help visualize the cutting action, arrow 32 illustrates the direction of the blade movement (substantially parallel to face 22*a* (FIG. 8) shown in dash lines) with arrow 33 illustrating the movement of the chips sliced off by the cutting edge 52.

The cutting edges 52 of the finishing blade 50 have a slight convex curvature as best seen in FIG. 6. In this embodiment, the cutting edges 52 are on the order of 1⅝ inches long. The curvature of the cutting edge 52 is exaggerated in FIG. 6 for drawing clarity and the maximum height of the curvature of the cutting edge 52 from a cord 60 (dashed line) extended from the corners 56 and 58 of the cutting edge 52 is on the order of five to six thousandths. This height is indicated by the arrow 62 in FIG. 6.

Figure 7:
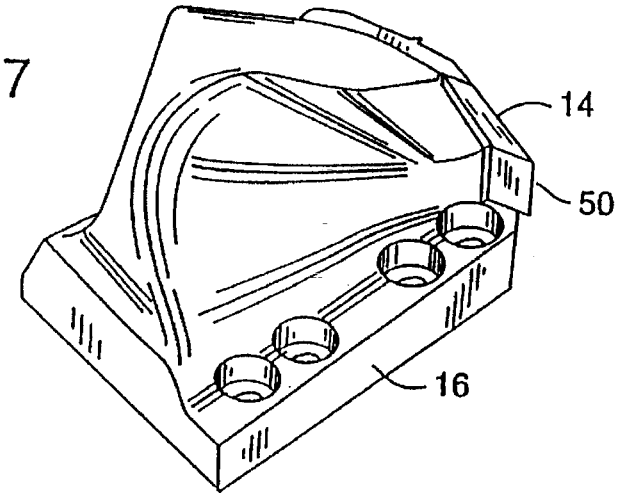
FIG. 7 is a view of the finishing blade of FIG. 4 installed on a blade holder.

A typical holder 16 for mounting the hogging blade 14 and the finishing blade 50 is illustrated in FIG. 7. The blades 14 and 50 are mounted to the holder 16 in a conventional manner. Multiple holders 14 are then mounted to the chipper 10 of FIG. 1A.

Figure 8:
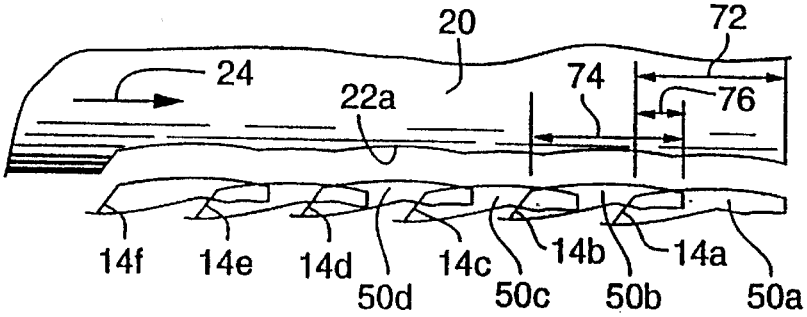
FIG. 8 is a view illustrating the finish produced by the finishing blade of FIG. 4.

FIG. 8 is a view similar to FIG. 3 (i.e., as if taken on view lines 3—3 of FIG. 2) and illustrates the type of finish produced on the surface of the log 20 (referred to as surface 22*a* in FIG. 8) by the finishing blades 50 of the present invention. The finishing blades 50 (like blades 12) are arranged to have an overlapping arrangement. That is, a succeeding blade 50 will overlap the cut of the preceding blade 50 as the chipper 10 is rotated to remove the unusable material 26 off the log 20. FIG. 8 illustrates in an exaggerated condition, the surface 22*a* produced by the finishing blades 50.

As previously mentioned, the blades 50 of the chipper 10 will be traveling in an overlapping arrangement as the chipper 10 is rotated to remove the material 26 from the log 20. In reference to FIG. 8, the log 20 is moved into the chipper 10 as indicated by arrow 24. The chipper 10 as it is rotated will remove the unusable material from the log 20 by the blades 14 and 50. The blades 50 will travel along the log 20 in an overlapping travel arrangement to produce the surface 22*a*. As shown in FIG. 8, finishing blade 50*a* will produce a length of cut as indicated by arrow 72. The succeeding finishing blade 50*b* will produce a length of cut as indicated by arrow 74 on the surface 22*a* of the log 20. Finishing blade 50*b* will overlap the cut produced by finishing blade 50*a* and the overlapping portion is indicated by arrow 76.

Figure 8A:
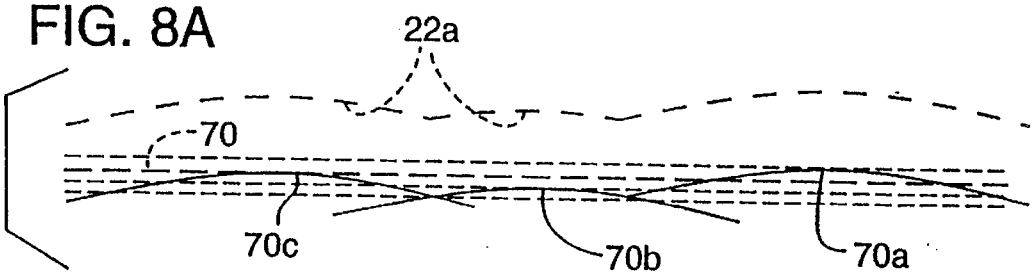
FIG. 8A is an enlarged view of a portion of FIG. 8.

The cutting edges 52 of the finishing blades 50 have a slight curvature as previously mentioned. The slight curvature of the cutting edges 52 produce overlapping cuts and avoids the jagged edges 40 illustrated in FIG. 3. Refer to FIG. 8A which is an enlarged view of a portion of surface 22*a* shown dash lines. Line 70 represents the desired position of the peak of the cutting edge 52 of the blade 50 to generate the face 22*a*. The curved lines 70*a*, 70*b* and 70*c* illustrate the cutting paths of blades 50*a*, 50*b* and 50*c* that generate the actual surface 22*a*. Blade 50*a*, and accordingly cutting path 70*a*, is inset from line 70 by the maximum 0.002 inch. Blade 50*b* is outset from line 70 the maximum 0.002 inch and blade 50*c* is centered on line 70. Because the blades overlap by about one-third of their length (1⅝ inch long with ⅝ inch overlap), a curvature height (see arrow 62 in FIG. 6) of 0.006 inch will substantially insure that the cutting paths of any two adjacent blades will intersect, assuming a maximum offset between them of 0.004 inch. Curved lines 70*a* and 70*b* represent the maximum relative offset that can exist as between two adjacent cutters and as will be seen, the tip of 70*a* intersects line 70*b*. Thus, jagged edges (e.g., reference 40 in FIG. 3) and feathering are avoided.

Surface 22*a* in FIG. 8 is shown as arcuate segments. These arcs are exaggerated for purposes of illustration and in reality the surface 22*a* will appear plain and smooth. Similarly the blades 50 illustrated in FIG. 8 and which are offset from the surface 22*a* for illustrative purposes have the curvature of the cutting edges exaggerated for illustration purposes. The length of the blade is 1⅝ inch as compared to a curvature height of 0.006 inch or a length that is substantially 300 times the height deviation.

Whereas the offsets of the straight blades are similarly very small, they nevertheless will produce visual edges and, of course, feathering. With the radiused blades producing intersecting cuts as illustrated in FIG. 8*a*, there are no visual edges or feathering.

It will be appreciated that the length of the cutting edge 52 of the blade 50 may be varied as well as the curvature of the cutting edge 52 to suit. The dimensions given are for example only and therefore may be varied for the intended application.

Those skilled in the art will recognize that variations and modifications may be made without departing from the true spirit and scope of the invention. The invention is therefore not to be limited to the embodiments described and illustrated but is to be determined from the appended claims.

I claim:

1. An open face chipper for chipping an open face in a log comprising:

a plurality of finishing blade edges mounted on the chipper for cutting along the plane of the desired open face in a log, said blade edges mounted for sequential cutting with succeeding blade edges overlapping the path of cut of the preceding blade edge in part and extending the path of the cut along the desired face in part;

said blade edges maintained on the chipper with the blade edges extended in parallel relation and positioned within an established tolerance distance on each side of a common plane, said blade edges are convexly curved as presented to the desired open face in the log, said overlapping blade edges and convex curve of the cutting edges cooperatively arranged for producing substantially intersecting cuts of each succeeding blade as maintained within the established tolerance.

2. An open face chipper as defined in claim 1 wherein the blade edges overlap by about one-third the length of the blade edges and the peak-to-valley dimension of the curve of the blade edges is about three times the desired established tolerance distance.

3. An open face chipper as defined in claim 2 wherein the knife edges are about 1⅝ inch long and overlap by about ⅝ inch, and said tolerance is about plus or minus 0.002 inch and the peak-to-valley height of the curve is about 0.006 inch.

* * * * *